US009734656B2

(12) United States Patent
Fong

(10) Patent No.: US 9,734,656 B2
(45) **Date of Patent: *Aug. 15, 2017**

(54) GAMING SYSTEM AND A METHOD OF GAMING

(71) Applicant: Aristocrat Technologies Australia Pty Limited, North Ryde, NSW (AU)

(72) Inventor: Colin Fong, Penshurst (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/200,850

(22) Filed: Jul. 1, 2016

(65) Prior Publication Data

US 2016/0314646 A1 Oct. 27, 2016

Related U.S. Application Data

(63) Continuation of application No. 14/049,003, filed on Oct. 8, 2013, now Pat. No. 9,384,624.

(30) Foreign Application Priority Data

Oct. 9, 2012 (AU) ..... 2012904412

(51) Int. Cl.
*G07F 17/32* (2006.01)
*G07F 17/34* (2006.01)

(52) U.S. Cl.
CPC ..... *G07F 17/3213* (2013.01); *G07F 17/3211* (2013.01); *G07F 17/3244* (2013.01); *G07F 17/3262* (2013.01); *G07F 17/34* (2013.01)

(58) Field of Classification Search
CPC ..... G07F 17/32; G07F 17/3211
USPC ..... 463/31
See application file for complete search history.

(56) References Cited

U.S. PATENT DOCUMENTS

| | | | |
|---|---|---|---|
| 4,126,314 | A | 11/1978 | Martin |
| 4,890,098 | A | 12/1989 | Dawes et al. |
| 5,102,137 | A | 4/1992 | Ekiert |
| 5,364,100 | A | 11/1994 | Ludlow et al. |
| 5,511,784 | A | 4/1996 | Furry et al. |
| 5,890,962 | A | 4/1999 | Takemoto |
| 7,364,431 | B2 | 4/2008 | Schwartz |
| 9,384,624 | B2 | 7/2016 | Fong |

(Continued)

FOREIGN PATENT DOCUMENTS

| | | | |
|---|---|---|---|
| CN | 2580595 | Y | 10/2003 |
| CN | 201192570 | Y | 2/2009 |

(Continued)

*Primary Examiner* — David L Lewis
*Assistant Examiner* — Shauna-Kay Hall
(74) *Attorney, Agent, or Firm* — McAndrews, Held & Malloy, Ltd.

(57) ABSTRACT

A gaming system comprises a player interface (50) comprising a display on which a plurality of selectable symbol display positions are displayed to a player, the player interface (50) allowing a player to select one or more windows (700-703) defining respective ones of one or more subsets of the symbol display positions (600), and a game controller (60) arranged to select symbols for display at all symbol display positions (600), and to evaluate selected symbols within each selected window based on a win entitlement applying to the selected window to determine a game outcome.

20 Claims, 10 Drawing Sheets

(56) References Cited

U.S. PATENT DOCUMENTS

| | | | | |
|---|---|---|---|---|
| 2002/0142829 | A1 | 10/2002 | Inoue | |
| 2003/0216167 | A1 | 11/2003 | Gauselmann | |
| 2004/0224745 | A1 | 11/2004 | Bregenzer | |
| 2005/0233794 | A1 | 10/2005 | Cannon et al. | |
| 2007/0105611 | A1* | 5/2007 | O'Halloran | G07F 17/3244 463/16 |
| 2007/0172800 | A1 | 7/2007 | Schwartz | |
| 2008/0076521 | A1 | 3/2008 | Little | |
| 2009/0117982 | A1* | 5/2009 | Bramble | G07F 17/34 463/20 |
| 2009/0325675 | A1* | 12/2009 | Shai-Hee | G07F 17/32 463/20 |
| 2010/0087242 | A1 | 4/2010 | Abe et al. | |
| 2011/0319153 | A1 | 12/2011 | Gomez et al. | |
| 2014/0094249 | A1* | 4/2014 | Gugler | G07F 17/34 463/20 |

FOREIGN PATENT DOCUMENTS

| | | | |
|---|---|---|---|
| EP | 2141672 | A1 | 1/2010 |
| JP | 11033221 | A | 2/1999 |
| JP | 2003199865 | A | 7/2003 |
| JP | 2003199874 | A | 7/2003 |
| JP | 2003199877 | A | 7/2003 |
| JP | 2004267242 | A | 7/2003 |
| JP | 2004081341 | A | 3/2004 |
| JP | 2007229088 | A | 9/2007 |
| JP | 2007289527 | A | 11/2007 |
| JP | 2008237437 | A | 10/2008 |
| JP | 2009028293 | A | 2/2009 |
| JP | 2010051464 | A | 3/2010 |
| KR | 20000030511 | A | 8/2000 |
| KR | 20040017615 | A | 2/2004 |
| KR | 20060116986 | A | 11/2006 |
| KR | 20080035668 | A | 4/2008 |
| KR | 20080111296 | A | 12/2008 |
| KR | 20090057756 | A | 6/2009 |
| KR | 100915431 | B1 | 9/2009 |
| KR | 100917931 | B1 | 9/2009 |
| WO | 2005014130 | A2 | 2/2005 |
| WO | 2005014130 | A3 | 4/2005 |

* cited by examiner

GAMING SYSTEM AND A METHOD OF GAMING

RELATED APPLICATIONS

This application is a continuation of U.S. patent application Ser. No. 14/049,003, having a filing date of Oct. 8, 2013, expected to issue as U.S. Pat. No. 9,384,624 on Jul. 5, 2016, which claims priority to Australian Provisional Patent Application No. 2012904412 having an International filing date of Oct. 9, 2012, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming systems are known where a player can select a number of win lines or reels to play and an amount to wager per reel. While such gaming systems provide players with enjoyment, a need exists for alternative gaming systems in order to maintain or increase player enjoyment.

BRIEF SUMMARY OF THE INVENTION

In a first aspect, the invention provides a gaming system comprising:

- a player interface comprising a display on which a plurality of selectable symbol display positions are displayed to a player, the player interface allowing a player to select one or more windows defining respective ones of one or more subsets of the symbol display positions; and
- a game controller arranged to select symbols for display at all symbol display positions, and to evaluate selected symbols within each selected window based on a win entitlement applying to the selected window to determine a game outcome.

In an embodiment, the size and number of selected windows depends on at least one selection criterion.

In an embodiment, one selection criterion comprises an amount of the wager placed by the player.

In an embodiment, one selection criterion comprises a minimum window size.

In an embodiment, one selection criterion comprises the number of selectable display positions.

In an embodiment, the player interface is operable such that the player can position a window relative to the symbol display positions to select the subset of display positions.

In an embodiment, upon a plurality of windows being selected, one of the selected windows can be positioned at least one of adjacent to, spaced from, intersecting with, or wholly within another one of the selected windows.

In an embodiment, the player interface is operable to select the win entitlement to apply to each window.

In an embodiment, the player interface is operable to select different win entitlements for different windows and the game controller is arranged to determine the game outcome based on the win entitlement specified for each window.

In an embodiment, the same win entitlement is applied to each window.

In an embodiment, the win entitlement comprises a number of win lines of an available number of win lines to be used in evaluation of the game outcome with respect to each window, each win line extending through a plurality of symbol display positions.

In an embodiment, the player interface comprises a touch screen and the player can move, select or re-size the one or more windows via interaction with the touch screen.

In a second aspect, the invention provides an electronic method of gaming comprising:

- presenting a plurality of selectable symbol display positions on a display to a player;
- receiving a selection of one or more windows, each window defining a subset of the symbol display positions;
- selecting symbols for display at all of the symbol display positions; and
- evaluating selected symbols within each selected window based on a win entitlement applying to the selected window to determine a game outcome.

In an embodiment, the size and/or number of selected windows depends on an amount of the wager placed by the player In an embodiment, the method comprises changing the size of a window in response to a player input.

In an embodiment, the method comprises moving a window relative to the symbol display positions in response to a player input.

In an embodiment, upon a plurality of windows being selected, one of the selected windows can be positioned at least one of adjacent to, spaced from, intersecting with, or wholly within another one of the selected windows in response to a player input.

In an embodiment, the method comprises upon a plurality of windows being selected, applying different win entitlements to different windows.

In an embodiment, the method comprises upon a plurality of windows being selected, applying the same win entitlement to different windows.

In an embodiment, the win entitlement comprises a number of win lines of an available number of win lines to be used in evaluation of the game outcome with respect to each window, each win line extending through a plurality of symbol display positions.

In a third aspect, the invention provides a game controller for a gaming system, the game controller arranged to:

- control a display to display a plurality of selectable symbol display positions are displayed to a player;
- receive a selection of one or more windows defining respective ones of one or more subsets of the symbol display positions;
- select symbols for display at all symbol display positions; and
- evaluate selected symbols within each selected window based on a win entitlement applying to the selected window to determine a game outcome.

In an embodiment, the size and number of selected windows depends on at least one selection criterion.

In an embodiment, one selection criterion comprises an amount of the wager placed by the player.

In an embodiment, one selection criterion comprises a minimum window size.

In an embodiment, a selection criterion comprises the number of selectable display positions.

In an embodiment, the game controller responsive to a player input such that the player can position a window relative to the symbol display positions to select the subset of display positions.

In an embodiment, upon a plurality of windows being selected, one of the selected windows can be positioned at least one of adjacent to, spaced from, intersecting with, or wholly within another one of the selected windows.

In an embodiment, the game controller is adapted to receive a win entitlement to apply to each window.

In an embodiment, the game controller is arranged to apply different win entitlements to different windows.

In an embodiment, the game controller is arranged to apply the same win entitlement to each window.

In an embodiment, the win entitlement comprises a number of win lines of an available number of win lines to be used in evaluation of the game outcome with respect to each window, each win line extending through a plurality of symbol display positions.

In an embodiment, the game controller is arranged to receive a player input via a touch screen such that the player can move, select or re-size the one or more windows via interaction with the touch screen.

In a fourth aspect, the invention provides computer program code which when executed implements the above method.

In a fifth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
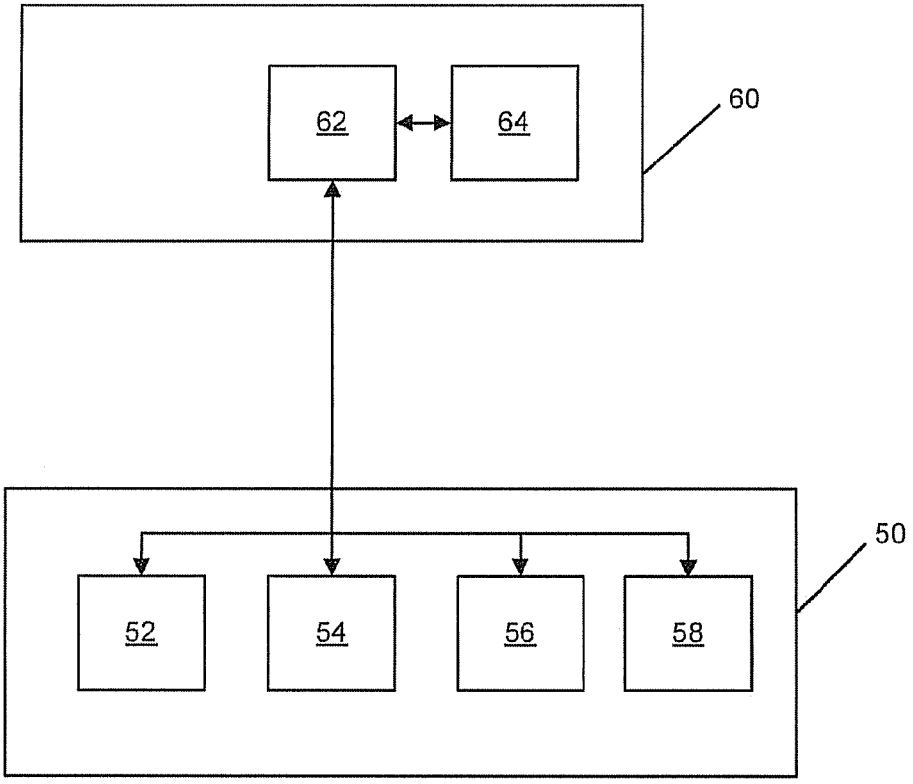
FIG. 1 is a block diagram of the core components of a gaming system.

Referring to the drawings, there is shown a gaming system having a game controller arranged to implement a game where a player can select one or more windows that define subsets of symbol display positions at which symbols will be selected. Symbols are selected for all display positions. The symbols within player selected windows are evaluated to determine if the player has one or more winning outcome.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58. The player interface may also comprise one or more input devices to allow a player to interact with the player interface. The input devices may comprise a touch screen display or one or more buttons or both.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
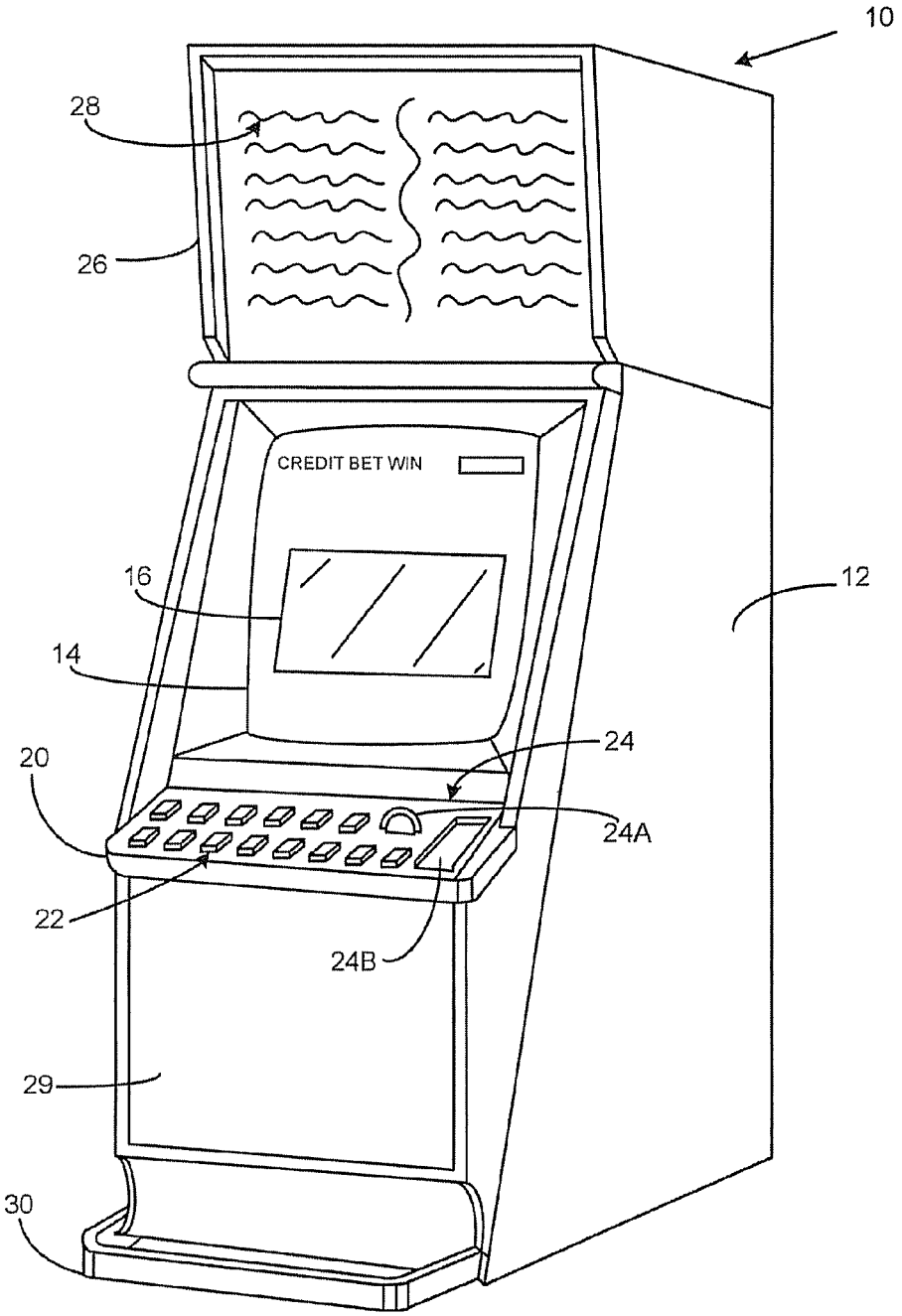
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type. The display 14 may be a touch screen display that is arranged to receive user inputs or commands via the touch screen display.

Figure 3:
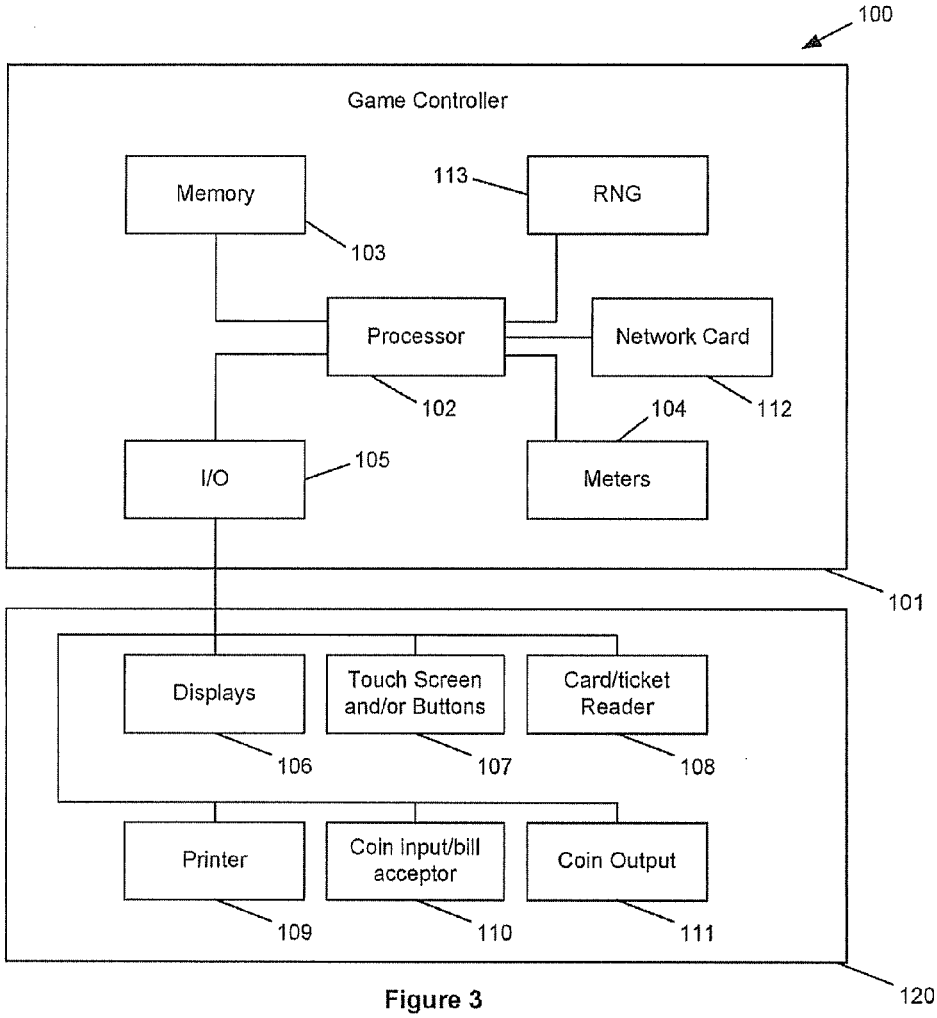
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
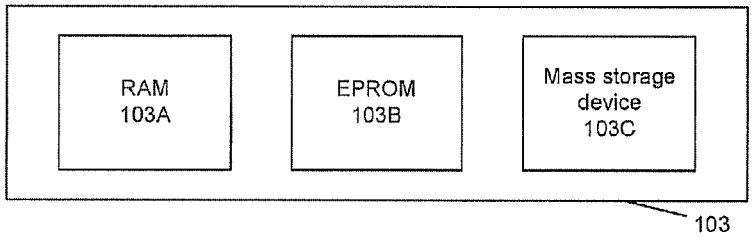
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
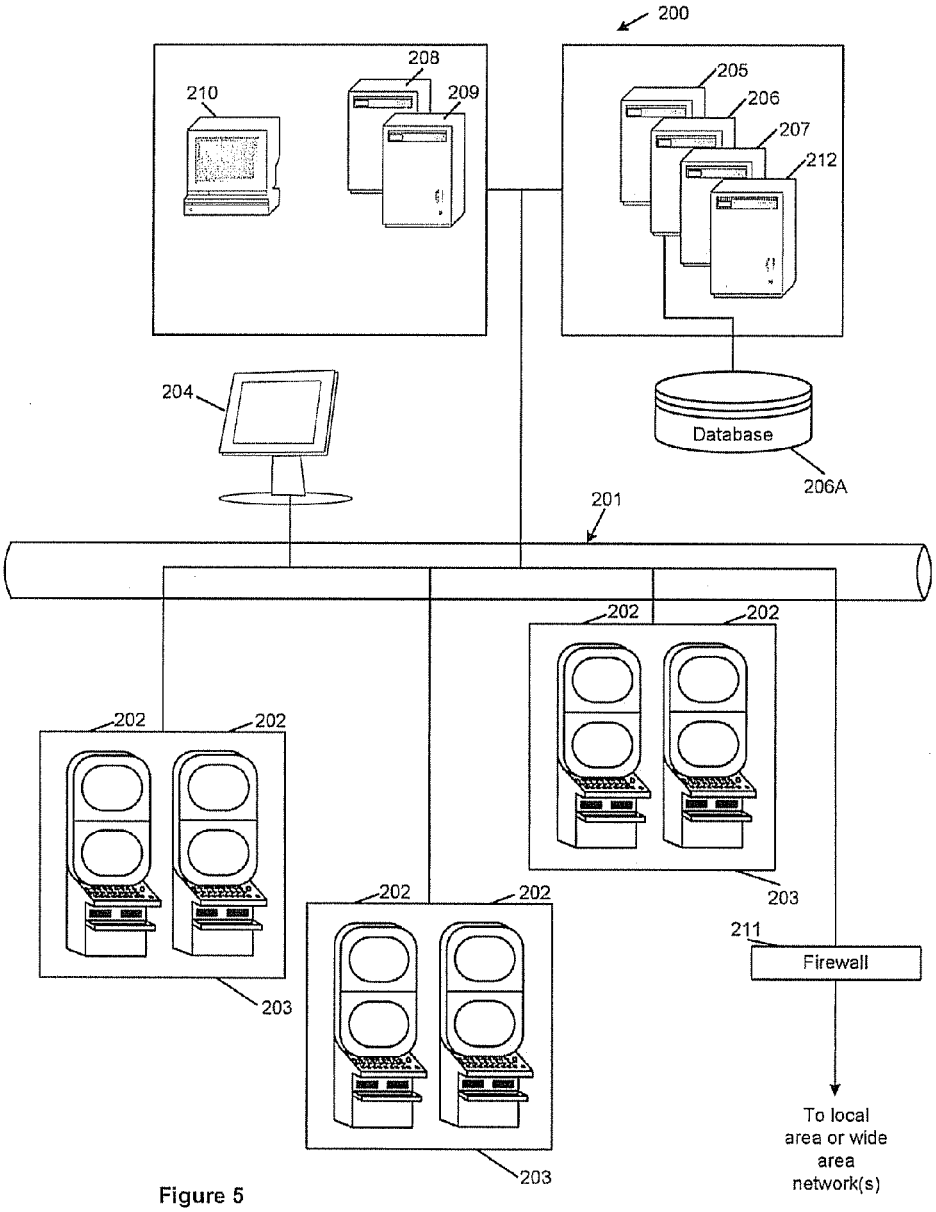
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 6:
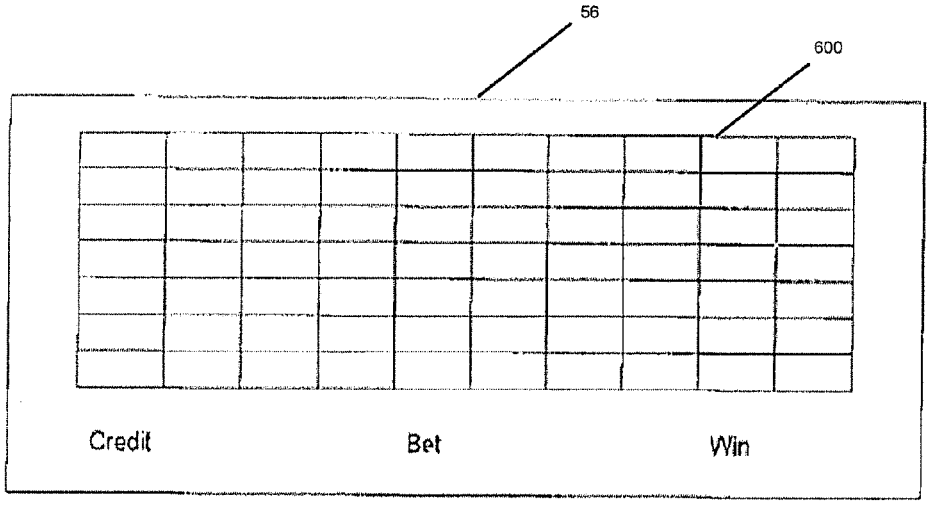
FIG. 6 shows a display with a plurality of selectable symbol display positions
Figure 8:
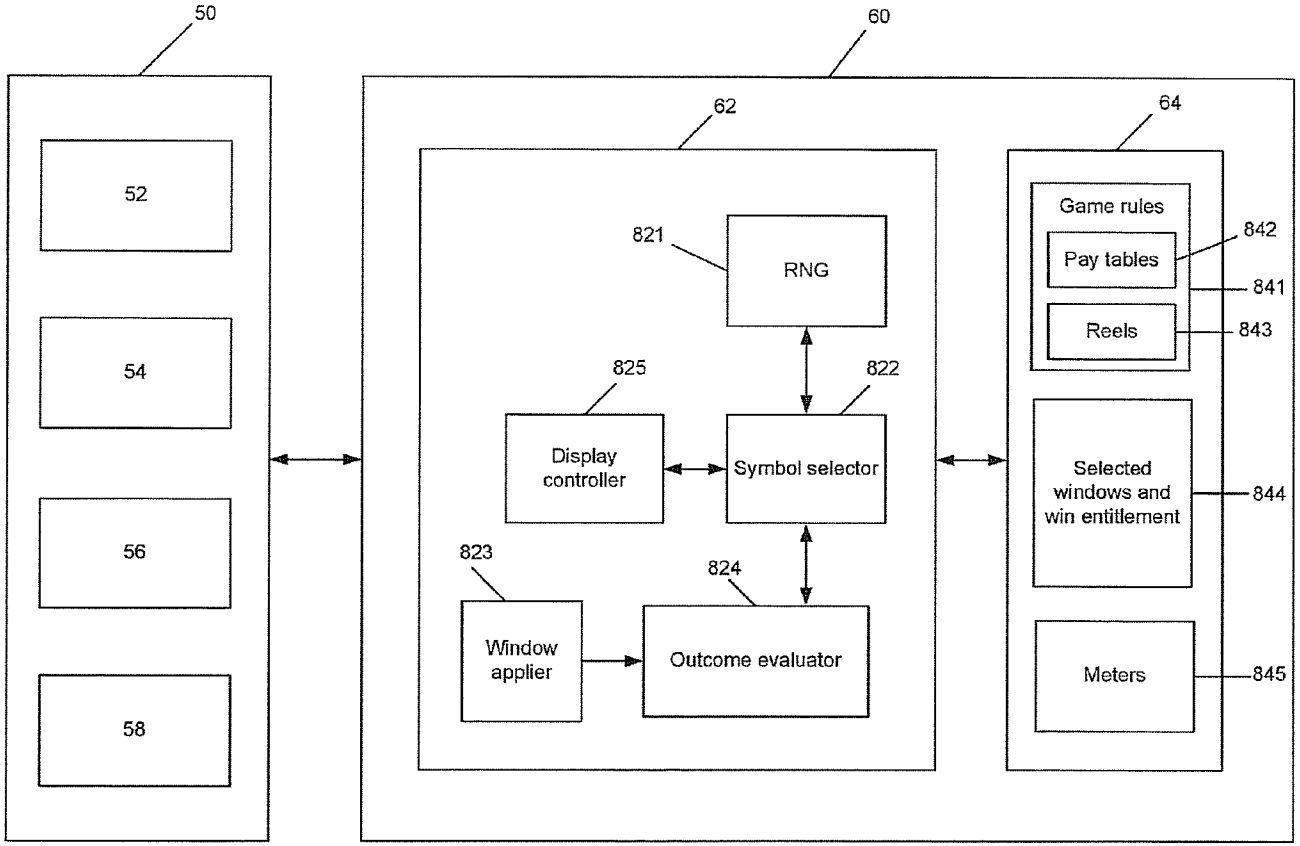
FIG. 8 is a block diagram of a gaming system of an embodiment.

Referring to FIG. 8, the processor 62 of game controller 60 is shown implementing a number of modules based on program code and data stored in memory 64. Persons skilled in the art will appreciate that one or more of the modules could be implemented in some other way, for example by a dedicated circuit. The gaming system of FIG. 8 is arranged such that the player operates the game play mechanism 56 of player interface 50 to specify a wager for a play of the game. In the embodiment, the player places a wager in a number of stages including selecting and positioning one or more windows over selectable symbol display positions 600 as shown in FIG. 6 and specifying a win entitlement to be applied to each window.

That is, the display 56 comprises a plurality of selectable symbol display positions 600. The symbol display positions 600 can comprise a n×m grid of symbol display positions. The n×m grid can be any sized grid. In the example of FIG. 6, there are 70 display positions shown in an array formed by 10 columns and 7 rows of symbol display positions.

The player can select one or more windows that define a subset of the symbol display positions provided the player's selection complies with game rule 841. The player can select a window through placing a wager. In one embodiment, to form the wager, the player initially indicates how many windows they wish to place over the symbol display positions. The window or windows are then displayed on the display 56 and the player operates one or more input devices to position the windows relative to the symbol display positions. For example, a window may be displayed as a touchable window on a touch screen display and the player may drag the object to a desired position relative to the symbol display positions. In another embodiment, the player could operate arrow buttons to position the windows. The player interface 50 allows the player to select which window to move when there are plural windows, for example by providing a button that allows a player to cycle through individual windows.

In some embodiments, in addition to specifying the window to apply, the player may also select a win entitlement to be evaluated in respect of the window. In other embodiments, the win entitlement may be fixed. In some embodiments, the gaming system may allow different win entitlements to be selected and applied to different windows. In other embodiments, the same win entitlement may apply to all windows.

It will be appreciated, that as the player makes choices, a wager will be built, typically in a number of credits and displayed to the player. The player may adjust their selection of windows and/or win entitlement in order to adjust the wager.

In other embodiments, a player may decide on a wager amount which affects what selections of windows and win entitlements are available.

The win entitlement may be selected from those known in the art. Persons skilled in the art will appreciate that a player's win entitlement may vary from game to game dependent on player selections. In one example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of "reels" to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel (or column) can be used to form symbol combinations with symbols displayed at a designated, symbol display positions of the other reels. For example, if in a window, there are fifteen symbol display positions, arranged in a five by three grid, the symbols displayed in the center row are used for non-selected reels/columns. As a result, the total number of ways to win is determined by multiplying the number of active display positions of each column, the active display positions being all display positions of each selected column and the designated display position of the non-selected columns. As a result for five columns and fifteen display positions there are 243 ways to win.

Once a player has chosen to apply a win entitlement and window selection in one play of the game, the player may choose to apply the same wager (and hence selections) in a following play of the game. For example, by pressing a "play again" button.

Once the player initiates a play of the game, the game controller 60 generates a game outcome which will then be evaluated by outcome evaluator 823. The first part of forming the game outcome is for a symbol selector 822 to select symbols from a set of symbols specified by reel data 843 using random number generator 821. The selected symbols are advised to the display controller 825 which causes them to be displayed on display 54 at the set of display positions 60.

One example of selecting symbols is for the symbol selector 822 to select symbols for display from a plurality of symbol sets corresponding to respective ones of a plurality of spinning reels 843 specifying a sequence of symbols for each reel. In the embodiment, individual reels are associated with each display position, and the symbol selector selects a stopping position for each of the reels. In the example of FIG. 6, there would be 70 different reels.

In another embodiment, reels may be associated with a row or column such that the symbol selector 822 can select all of the symbols for a row or column by selecting a stopping position in the sequence such that the displayed symbols are determined from the symbol at the stopping position and those symbols that neighbor it. It is known to use a probability table stored in memory 64 to vary the odds of a particular stop position being selected. Other techniques can be used to control the odds of particular outcomes occurring to thereby control the return to player of the game.

As shown in relation to FIGS. 7*a*-7*f*, the player can select a plurality of windows 700, 701, 702, 703. In this respect, the selected windows define which symbol positions will be evaluated. The game controller has a window applier which applies the player selected windows 844 stored in memory by causing display of the windows on display 54 and controlling the outcome evaluator 824 to evaluate game outcomes based on pay table 842 and the player's win entitlement. Any awards are added to the win meter of meters 845.

The number of windows that can be selected may be dependent on several criteria. The main criterion for the number of windows selected is dependent on the amount of credits the player wagers or spends. For example a player can buy more for windows for more credits. The amount of windows that can be selected or bought may also be limited by the available symbol display positions within the display area 600. The game controller 60 is arranged to control the amount of windows a player can select based on game rules 841

Figure 7A:
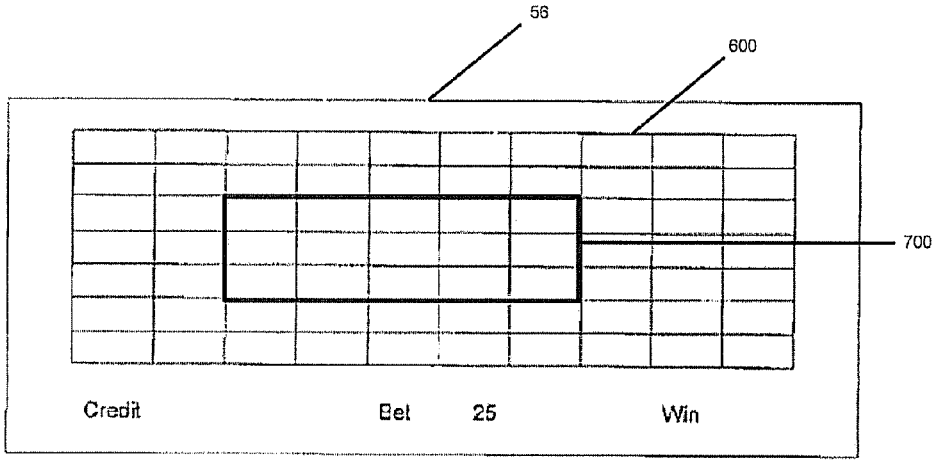
FIGS. 7*a* to 7*f* show examples of selected windows.

FIG. 7*a* shows a window 700 that has been selected by a player. The window shown in FIG. 7 is a 3×5 window Display 56 is also arranged to display the amount of money wagered or bet by the user. In FIG. 7*a* the screen shows the player has bet 25 to purchase the window 700.

Figure 7B:
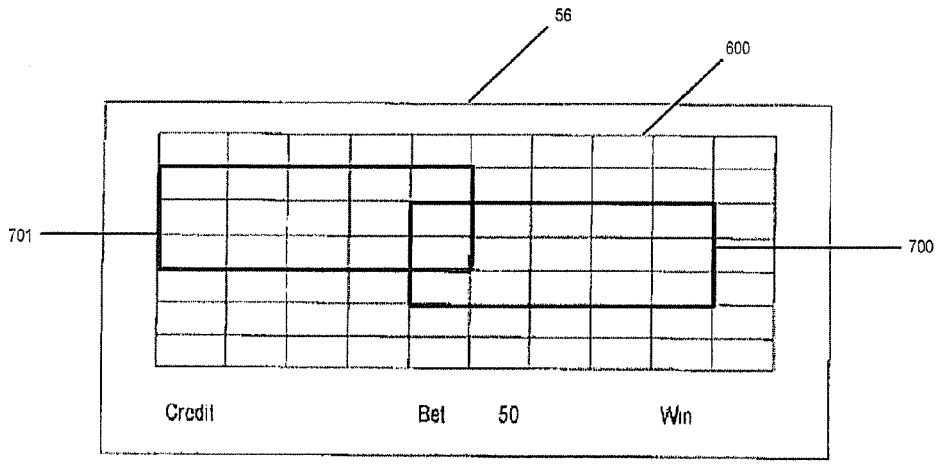
Figure 7C:
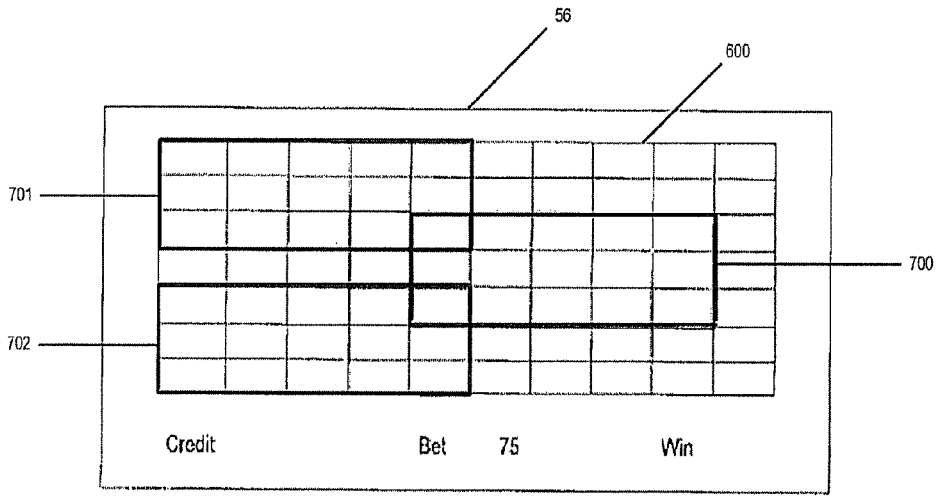
Figure 7D:
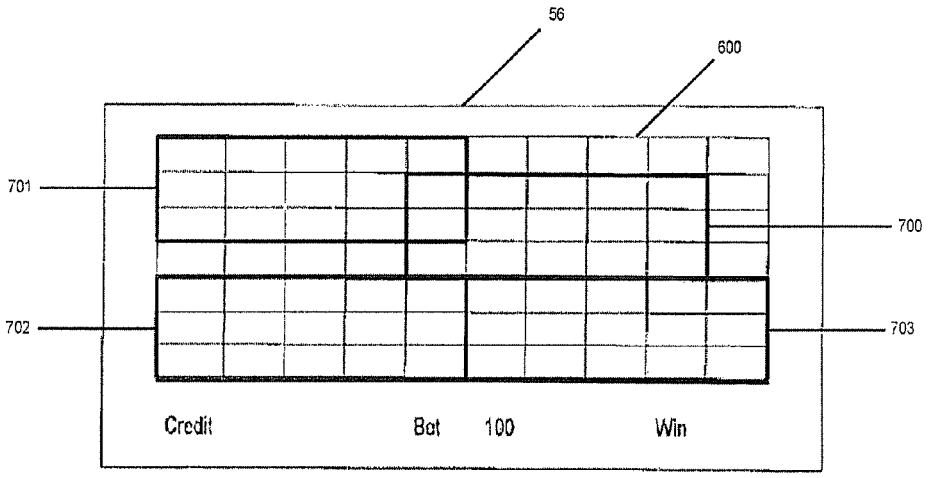

The player can buy and select multiple windows within the display area. The player selects additional windows by wagering more credits, i.e. buying more windows. FIGS. 7*b* to 7*d* show that the player can incrementally add windows such that a window is added in each of FIGS. 7*b*-7*d* such that FIG. 7*d* shows that the player has selected four windows 700, 701, 702 and 703.

Figure 7E:
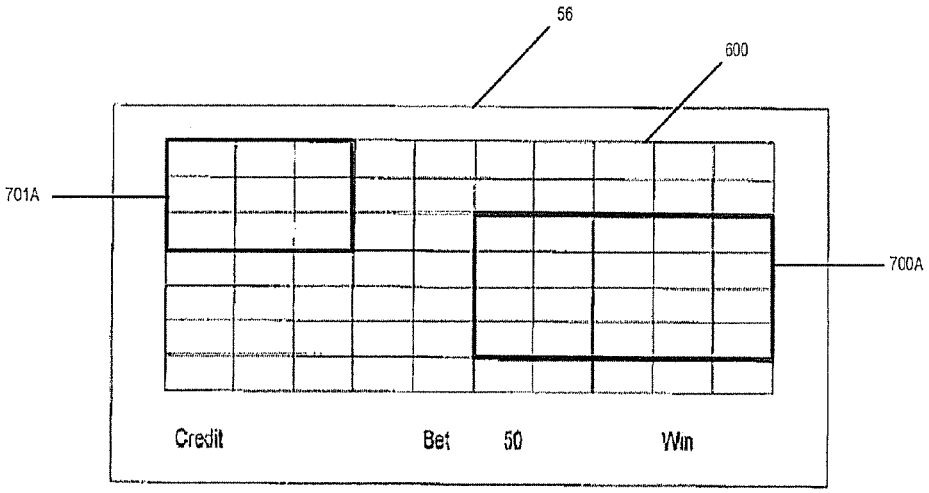

The player can move the position of a selected window 700, 701, 702, 703 around the display area. The window can be moved to define a different subset of symbol display positions. FIG. 7*e* shows window 700 being moved to a new position 700A. The player can also change the size of a selected window to define a different sub set of symbol display positions. In one form the player can move the window and change the size of the window 700, 701, 702, 703 by drag drop and re-sizing operations performed on a touch screen of the display. The controller 101 is arranged to receive the player inputs via the touch screen and process the player commands. The game controller is arranged to move a selected window within the display area 600 based on the drag drop operations performed on the touch screen.

Figure 7F:
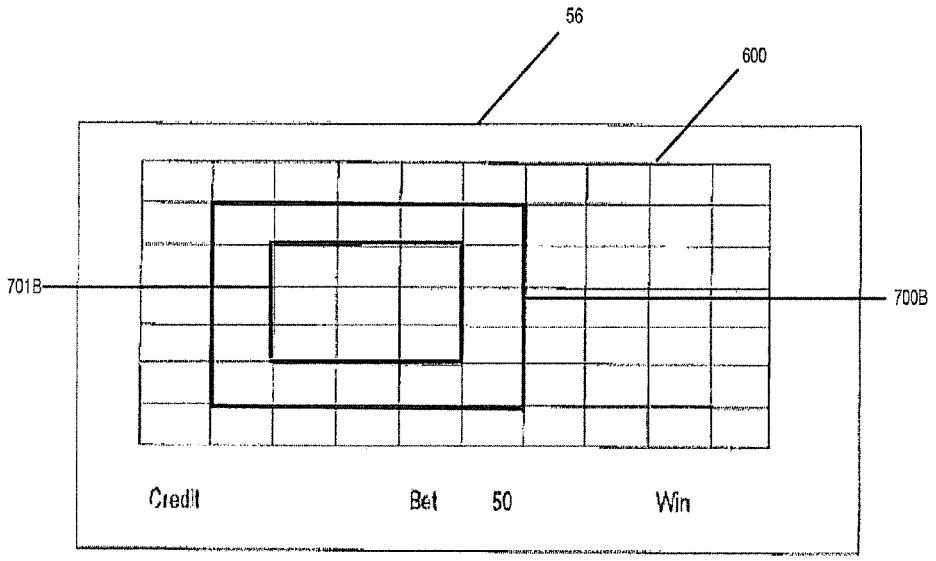

In one example the player can change the size of the selected window by touching and dragging the corner of the selected window. FIG. 7*e* shows window 701 (from FIGS. 7*b*-*d*) has been moved and re-sized the size as window 701A i.e. it has been made smaller as compared to FIG. 7*b* and window 700 has been moved and made larger to form window 700A. In this respect, it will also be appreciated that windows 700A, 701A could have been formed by the player initially, rather than by re-sizing an existing window, The one or more selected windows 700, 701, 702, 703 can be positioned adjacent or spaced from or intersecting with or wholly within the other one or more selected windows 700, 701, 702, 703. In one example one window can be positioned adjacent another selected window, e.g. windows 702,703 in FIG. 7*d*. In another example a selected window may be positioned in a position that is spaced apart from another selected window, e.g. windows 701 and 702 in FIG. 7*c*. In a further example a selected window may be positioned in a manner such that a portion of one selected window intersects with a portion of another selected window, e.g. windows 700 and 701 in FIGS. 7*b*, 7*c* and 7*d*. In another example a selected window 701B can be positioned inside another selected window 700B as shown in FIG. 7*f*.

The size and the allowable position of the windows can be controlled by a set of rules defined and implemented by the controller. The controller can restrict the size and position of the windows depending on the available symbol display positions and depending on the game rules 841. For example, the size of the window may be required to be smaller than the size of the set of symbol display positions or there may be a defined maximum size to the window.

The outcome evaluator 824 of game controller evaluates the selected symbols within a selected window and determines a game outcome based on the win entitlement. As indicated above, in one example, the win entitlement is based on a selected number of win lines of an available number of win lines to be used in evaluation of the game outcome, each win line extending through a plurality of symbol display positions In one example the player can play games such as a reel power game or a 25 line game or a 3 reel game or 6 reel game in different windows. In some embodiments, the type of win entitlement may depend on window size. The game controller 60 controls the type of game that can be played by determining the size of the window based on game rules. Further in some embodiments different pay tables may apply depending on the size of the window and/or the type of win entitlement specified by the player. For example, different awards may apply to reel power games relative to win line based games.

The game controller can be programmed so as to display special features or hot spots at certain positions on the grid. For example these special features may be multipliers or wilds to provide additional excitement into the game. Another example is that a feature like a "reel shuffle" may be implemented such that symbols within a window are re-arranged if a condition is met. Such a feature may be implemented separately for each window, e.g. if windows overlap.

Game outcomes within one or more window, may provide additional game play, such as a feature game. Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

The trigger event may be, a symbol combination in the game, occurrence of a specific symbol in the game, purchased, be caused by another connected system, based on turnover, based on a random evaluation, etc.

Persons skilled in the art will appreciate that there may be more than one game round in a play of the gaming system such as is the case when a series of free spins is awarded. In this respect, a game round involves at least one of the reels being "spun"—e.g. new symbols of the reels are selected for display at the display positions and the reel is either physically or virtually spun to a stop. The outcome of a game round may be no win, a win (for example from a winning combination of symbols), a contribution towards a win accrued over a plurality of game rounds, a trigger condition occurring etc. As indicated above, a winning outcome will result in some form of award being made such as an award of credits based on the pay table 843. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Figure 9:
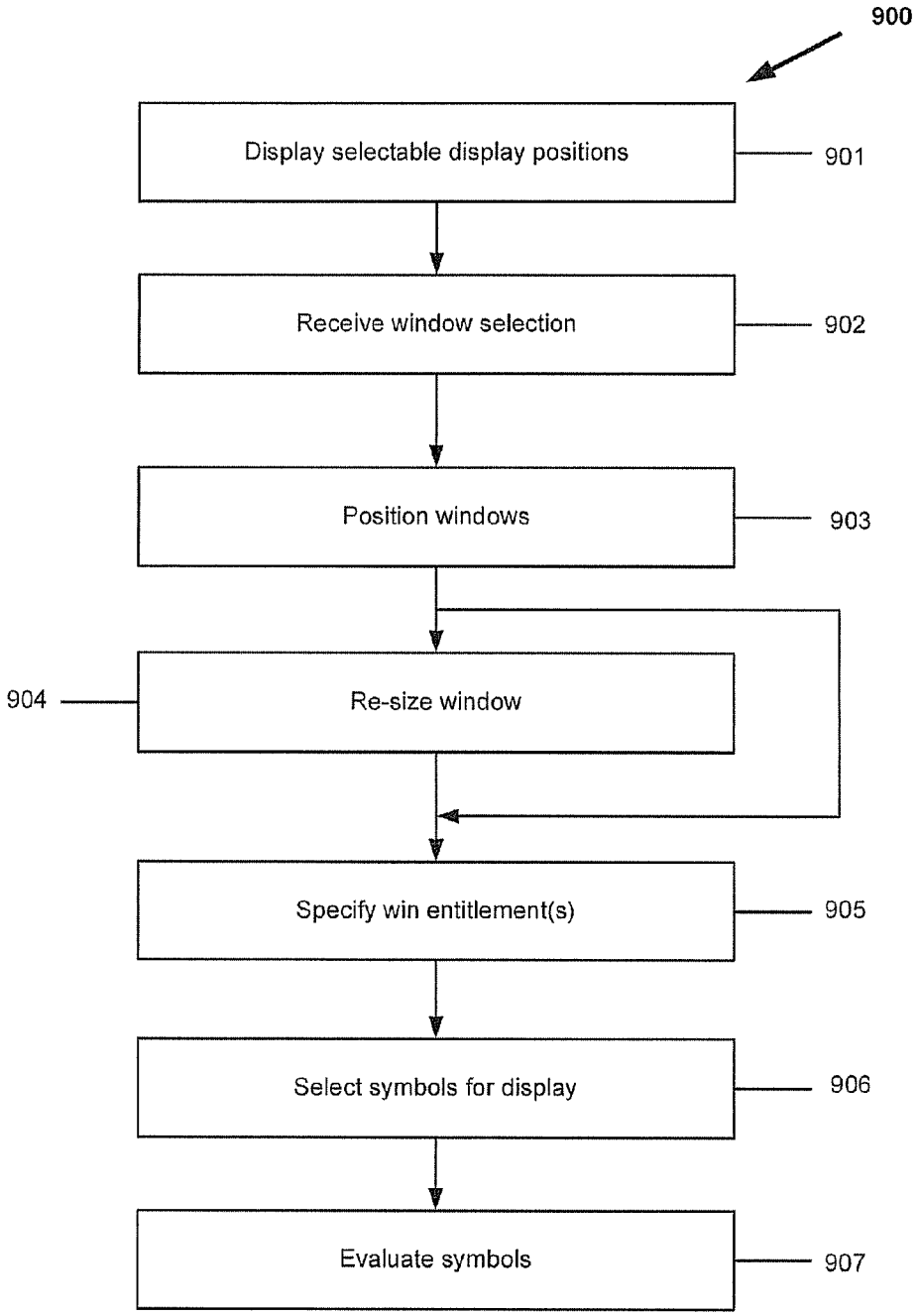
FIG. 9 is a flow chart of an embodiment.

FIG. 9 shows an embodiment of a method of gaming 900. A plurality of selectable symbol display positions, are presented 901 to a player on the display. At step 902, the method comprises receiving a selection of one or more windows to be placed relative to the selectable symbol display position to define a subset of the symbol display positions, based on player instructions. The player can purchase one or more windows via the player interface.

At step 903 the player can move the position of any one or more windows. The player can move the position of the windows, for example, by interacting with the touch screen of the player interface 50. In one embodiment the player can move the windows by drag and drop operations performed on the touch screen.

At step 904 the player can optionally manipulate the size of any one or more of the selected windows. In one embodiment the player can change the size of the windows by interacting with the touch screen inputting commands by gestures on the screen, for example touching one or more corners of a particular selected window and dragging the corners in a direction to increase the size of the window or reduce the size of the window or change the shape of the window. The window can be manipulated to any size or shape within limits on the size and shape of the window controlled by the game controller 60. The limits are dependent on the number of available selectable symbol display positions within the display area or on other parameters defined within the controller, e.g. a minimum or maximum window size, a maximum or minimum number of columns etc.

It should be understood a player can select multiple windows as shown in FIGS. 7*a* to 7*f*. The selected windows can be positioned adjacent to each other, spaced apart from each other, partially intersecting one another or wholly within one another. Examples of this are shown in FIGS. 7*a* to 7*f*.

At step 905 the player can specify the win entitlement for each window. For example the player may play a reel power game in one window and play a 25 line game in another window. The type of games that can be played within a particular selected window may depend on the size of the window. Step 906 comprises selection of one or more symbols for display at all symbol display positions by symbol selector 822.

At step 907 the method involves evaluating the symbols within a selected window determining a game outcome based on a win entitlement. The win entitlement may be different for each type of game being played, each game outcome being evaluated based on an individual win entitlement.

If an award criterion is satisfied the player is provided with an award. The player may be awarded credits or additional game play. As explained earlier the game may incorporate one or more feature games that can be triggered as a result of the play of the game. If the game controller determines that a feature should be should be awarded the feature game is carried out. If plural feature games are awarded, these may be conducted separately in different display areas on the display 54 or one after the other.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming system comprising:

a credit input mechanism configured for player interaction to receive a credit input representing a monetary value for establishing a credit balance;

hardware meters configured to monitor the credit input having been provided by the credit input mechanism;

a player interface comprising a display on which a plurality of selectable symbol display positions are displayed to a player, the player interface configured to, in accord with said hardware meters having monitored the credit input having been provided by the credit input mechanism, allow a player to select a number of intersectable windows defining subsets of the symbol display positions; and a game controller configured to select symbols for display at the symbol display positions, to select a win entitlement based on a size of the selected subsets of the symbol display positions, and to evaluate the selected symbols within the selected window based on the selected win entitlement.

2. A gaming system as claimed in claim 1 wherein the size and number of selected windows depends on at least one selection criterion.

3. A gaming system as claimed in claim 2, wherein one selection criterion comprises an amount of the wager placed by the player.

4. A gaming system as claimed in claim 2, wherein one selection criterion comprises a minimum window size.

5. A gaming system as claimed in claim 2, wherein one selection criterion comprises the number of selectable display positions.

6. A gaming system as claimed in claim 1, wherein the player interface is operable such that the player can position a window relative to the symbol display positions to select the subset of display positions.

7. A gaming system as claimed in claim 1, wherein upon a plurality of windows being selected, one of the selected windows can be positioned at least one of adjacent to, spaced from, intersecting with, or wholly within another one of the selected windows.

8. A gaming system as claimed in claim 1, wherein the game controller is configured to determine the game outcome based on the win entitlement selected for each window.

9. A gaming system as claimed in claim 1, wherein the game controller is further configured to select different win entitlements for different windows and the game controller is further to determine the game outcome based on the win entitlement selected for each window.

10. A gaming system as claimed in claim 1, wherein the game controller is further configured to select the same win entitlement is applied to each window.

11. A gaming system as claimed in claim 1, wherein the win entitlement comprises a number of win lines of an available number of win lines to be used in evaluation of the game outcome with respect to each window, each win line extending through a plurality of symbol display positions.

12. A gaming system as claimed in claim 1, wherein the player interface comprises a touch screen and the player can move, select or re-size the one or more windows via interaction with the touch screen.

13. An electronic method of gaming in a gaming system having a credit input mechanism configured for player interaction to receive a credit input representing a monetary value for establishing a credit balance, hardware meters configured to monitor the credit input having been provided by the credit input mechanism, a player interface comprising a display on which a plurality of selectable symbol display positions are displayed, and a game controller, the method comprising:

establishing a credit balance via said credit input mechanism receiving the credit input;

in accord with said hardware meters having monitored the credit input having been provided by the credit input mechanism, presenting a plurality of selectable symbol display positions on the display;

receiving via the player interface a selection of a number of intersectable windows defining subsets of the symbol display positions;

selecting via the game controller symbols for display at the symbol display positions;

selecting via the game controller a win entitlement based on a size of the selected subsets of the symbol display positions; and evaluating via the game controller the selected symbols within the selected window based on the selected win entitlement.

14. A method as claimed in claim 13, wherein the size and the number of selected windows depends on an amount of the wager placed by the player.

15. A method as claimed in claim 14, comprising changing the size of a window in response to a player input.

16. A method as claimed in claim 13, comprising moving a window relative to the symbol display positions in response to a player input.

17. A method as claimed in claim 13, wherein upon a plurality of windows being selected, one of the selected windows can be positioned at least one of adjacent to, spaced from, intersecting with, or wholly within another one of the selected windows in response to a player input.

18. A method as claimed in claim 13, comprising, upon a plurality of windows being selected, applying different win entitlements to different windows.

19. A method as claimed in claim 11, comprising, upon a plurality of windows being selected, applying the same win entitlement to different windows.

20. A game controller for a gaming system having a display having a plurality of selectable symbol display positions, each of the symbol display positions being configured to display a symbol, a credit input mechanism configured for player interaction to receive a credit input representing a monetary value for establishing a credit balance, hardware meters configured to monitor the credit input having been provided by the credit input mechanism, the game controller configured to:

establish a credit balance via said credit input mechanism receiving the credit input;

in accord with said hardware meters having monitored the credit input having been provided by the credit input mechanism, presenting a plurality of selectable symbol display positions on the display;

receive via the player interface a selection of a number of intersectable windows defining subsets of the symbol display positions;

select symbols for display at the symbol display positions;

select a win entitlement based on a size of the selected subsets of the symbol display positions; and evaluate the selected symbols within the selected window based on the selected win entitlement.

* * * * *